US006547086B1

(12) United States Patent
Harvey

(10) Patent No.: US 6,547,086 B1
(45) Date of Patent: Apr. 15, 2003

(54) DISPLAY WALL PANEL

(75) Inventor: Thomas D. Harvey, Rockville, MD (US)

(73) Assignee: Russell-William, Ltd., Odenton, MD (US)

( * ) Notice: Subject to any disclaimer, the term of this patent is extended or adjusted under 35 U.S.C. 154(b) by 0 days.

(21) Appl. No.: 09/275,965

(22) Filed: Mar. 25, 1999

(51) Int. Cl.[7] ..... A47F 1/00

(52) U.S. Cl. ..... 211/87.01; 211/94.01; 248/224.61

(58) Field of Search ..... 211/59.1, 87.01, 211/94.01, 189; 248/220.31, 222.11, 222.12, 222.13, 223.41, 224.61, 225.11, 225.21

(56) References Cited

U.S. PATENT DOCUMENTS

| | | | | | |
|---|---|---|---|---|---|
| 3,297,290 | A | * | 1/1967 | Patterson | 211/59.1 X |
| 3,516,552 | A | * | 6/1970 | Salava | 211/87.01 |
| 3,977,109 | A | * | 8/1976 | Berry, Jr. et al. | 40/124.1 |
| 4,211,379 | A | | 7/1980 | Morgan et al. | 248/222.2 |
| 4,362,285 | A | * | 12/1982 | Lewis | 248/221.3 |
| 4,441,619 | A | * | 4/1984 | Gibitz | 211/59.1 X |
| 4,615,448 | A | | 10/1986 | Johnstonbaugh | 211/94 |
| 4,629,076 | A | | 12/1986 | Amstutz et al. | 211/94 |
| 4,805,863 | A | | 2/1989 | Armstrong et al. | 248/243 |
| 4,860,905 | A | * | 8/1989 | Schott et al. | 211/59.1 |
| 5,109,993 | A | * | 5/1992 | Hutchison | 211/87.01 |
| 5,360,121 | A | | 11/1994 | Sothman | 211/87 |
| 5,379,976 | A | * | 1/1995 | DeGirolamo | 248/221.2 |
| 5,412,912 | A | | 5/1995 | Alves | 52/36.5 |
| 5,484,067 | A | | 1/1996 | Sothman | 211/87 |

* cited by examiner

*Primary Examiner*—Daniel P. Stodola
(74) *Attorney, Agent, or Firm*—Norman E. Lehrer

(57) ABSTRACT

A display wall panel including a base member with a horizontal slot having a triangular cross-section. That is, the slot has an upper surface and a lower surface where the surfaces converge toward the opening of the slot. The system also includes a bracket having a curved portion with a top member and a bottom member where the curved portion fits into the slot and the top member bears against the upper surface of the slot and the bottom member bears aginst the lower surface of the slot. There is also provided a wall panel system which includes a base member with at least one horizontal slot extending therein. The slot has an upper surface, a lower surface, a rear surface, and an opening formed by an upper wall and a lower wall. The system also includes a bracket having a vertical member with a top member, a bottom member, and a curved portion extending outwardly from the vertical member. When the bracket is placed within the slot, the top member bears against the upper surface of the slot, the bottom member bears against the lower surface of the slot, and the curved portion rests on the lower wall of the opening.

4 Claims, 3 Drawing Sheets

DISPLAY WALL PANEL

BACKGROUND OF THE INVENTION

The present invention is directed toward a display wall panel and more particularly, toward a wall panel with a slot designed to provide improved strength to the panel.

Display wall panels with brackets attached thereto are typically used in stores to display articles of clothing, sporting equipment, household items, or other articles which can be supported by the brackets. A typical prior art display wall panel 110 is shown in FIGS. 1 and 2. The wall panel includes a base member 112 with a front side 114, a rear side 116, and a horizontally extending T-shaped slot 118 open to the front side 114 of the base member 112. The slot 118 has an opening 120 formed by an upper wall 122 and a lower wall 124 which form the stem of the T. (See FIG. 2.) The slot 118 also has a rear surface 126 parallel to the rear side 116 of the base member 112, an upper front surface 128, and a lower front surface 130 which form the cross portion of the T.

Bracket 132 has a vertical top portion 134, a curved portion 136, a vertical bottom portion 138, and a bar 140 which extends outwardly from the vertical bottom portion 138. The top portion 134 of the brackets 132 bears against the upper front surface 128 of the slot 118, the curved portion 136 rests on the lower wall 124 of the opening 120, and the vertical bottom portion 138 rests against the front side 114 of the base member 112. (See FIG. 2.) Hangers or other supports (not shown) may be hung from the bar 140. The articles to be displayed are then supported on these hangers. The bracket may be held at any location along the length of the slot. Also, each base member panel may have more than one slot and more than one bracket.

A potential problem with these wall panels is that they are usually made from particle board, which splits easily. Because most of the weight of the items being supported by the bracket bears against the upper front surface of the slot, the upper wall or corner of the slot will split and eventually break off. In order to increase the strength of the slot metal liners may be placed within the slot; however, these liners are expensive.

Various designs for slots are known. For example, U.S. Pat. No. 5,109,993 to Hutchison discloses a display wall panel with a slot having inclined upper and lower walls. The accessory bracket bears on the lower inclined wall of the slot. However, the upper inclined wall is not functional. Rather, the upper part of the bracket simply rests behind the upper wall, much like a conventional hanger. There is no interaction between the upper and lower inclined walls. Therefore, this design does not prevent the slot from splitting.

U.S. Pat. No. 5,360,121 to Sothman discloses a slotted display wall panel with a T-shaped slot. The opening has opposed angled walls. The accessory bracket engages the angled wall of the upper portion of the slot. This wall panel, however, also does not prevent the slot from splitting.

SUMMARY OF THE INVENTION

The present invention is designed to overcome the deficiencies of the prior art discussed above. It is an object of one embodiment of the present invention to provide a wall panel system which provides a slot with a triangular cross-section which provides improved strength to the wall panel.

It is a further object of the present invention to provide an interference fit between the slot of the wall panel and the bracket which helps to prevent rotation of the bracket.

In accordance with the illustrative embodiments demonstrating features and advantages of the present invention in a first embodiment there is provided a wall panel system which includes a base member with at least one horizontal slot extending therein. The slot has a triangular cross-section That is, the slot has an upper surface and a lower surface where the surfaces converge toward the opening of the slot. The system also includes a bracket having a curved portion with a top member and a bottom member where the curved portion fits in to the slot and the top member bears against the upper surface of the slot and the bottom member bears against the lower surface of the slot.

In a second embodiment of the present invention there is provided a wall panel system which includes a base member with at least one horizontal slot extending therein. The slot has an upper surface a lower surface, a rear surface, and an opening formed by an upper wall and a lower wall. The system also includes a bracket having a vertical member with a top member, a bottom member, and a curved portion extending outwardly from the vertical member. When the bracket is placed into the slot, the top member bears against the upper surface of the slot, the bottom member bears against the lower surface of the slot, and the curved portion rests on the lower wall of the opening.

Other objects, features, and advantages of the invention will be readily apparent from the following detailed description of the preferred embodiments thereof taken in conjunction with the drawings.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
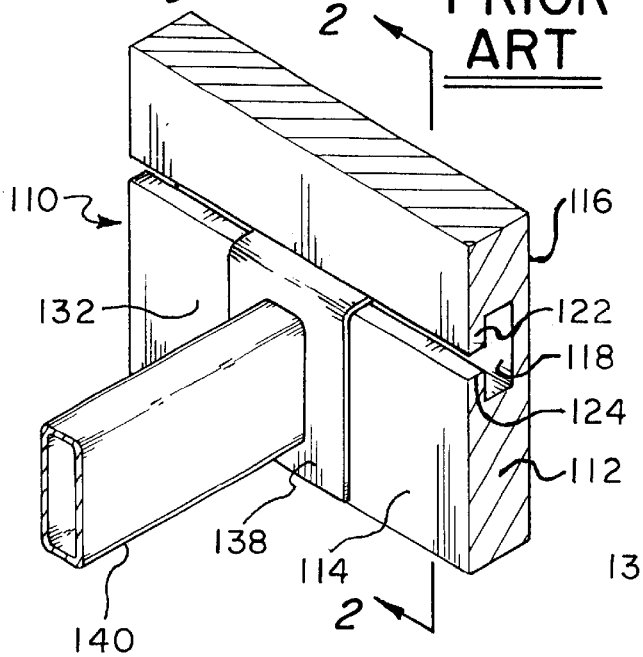
Fig. 1 PRIOR ART
FIG. 1 illustrates a prior art wall panel device with a T-shaped slot and an accessory bracket supported therein.
Figure 2:
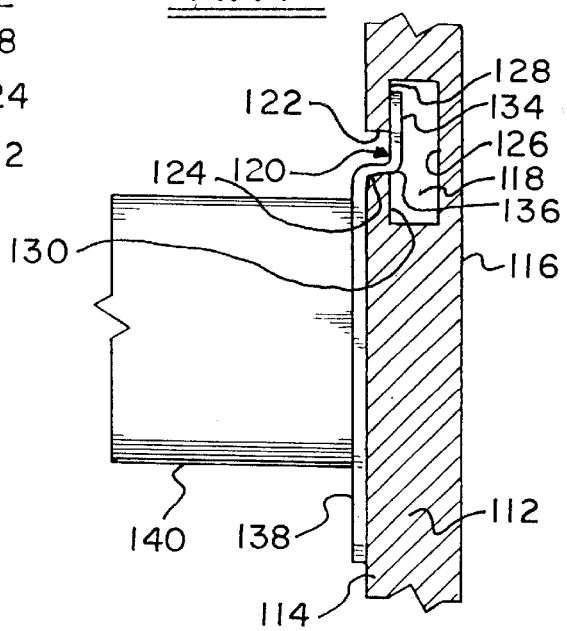
Fig. 2 PRIOR ART
FIG. 2 is a cross-sectional view of the prior art device shown in FIG. 1 taken along line 2—2.
Figure 3:
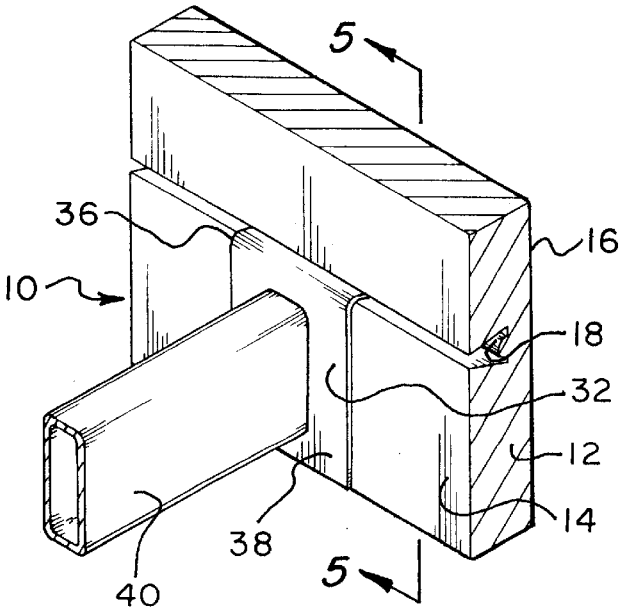
FIG. 3 is a perspective view of a first embodiment of the wall panel system of the present invention.
Figure 4:
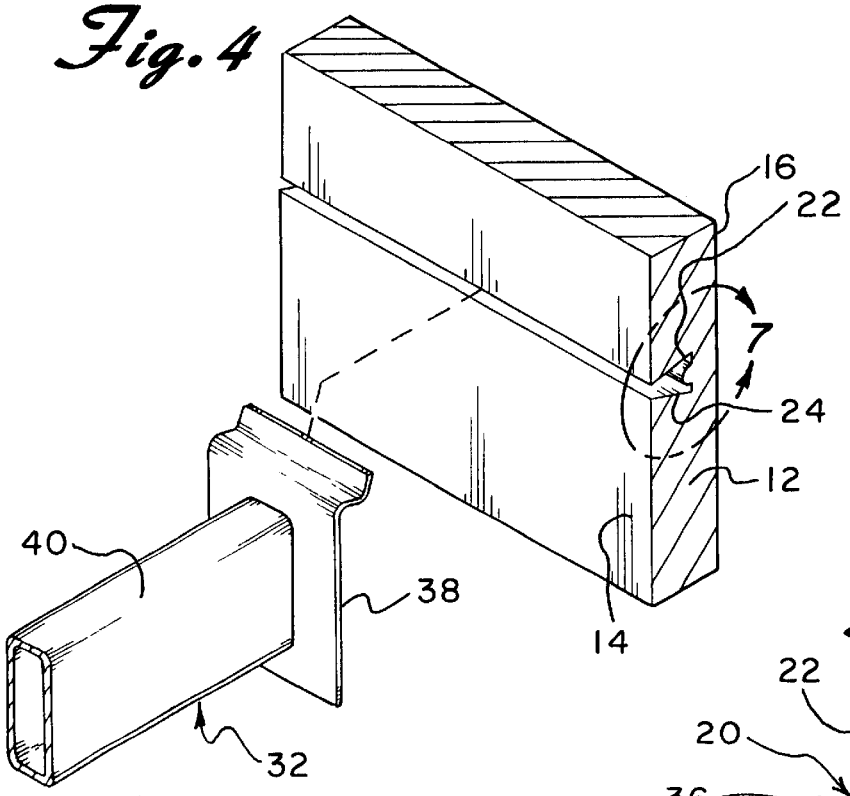
FIG. 4 is an exploded view of the first embodiment of the wall panel system of the present invention.

Referring now to the drawings in detail wherein like reference numerals have been used throughout the various figures to designate like elements, there is shown in FIG. 3 a panel wall system constructed in accordance with the principles of the present invention and designated generally as 10.

The first embodiment of the wall panel system of the present invention includes a base member 12 with a front side 14, a rear side 16, and at least one horizontal slot 18 extending along the front side 14. (FIG. 3.) While only one slot 18 has been shown and will be discussed, it should be realized that any number of slots may be located within the panel, depending upon the size of the panel and the needs of the user.

Figure 5:
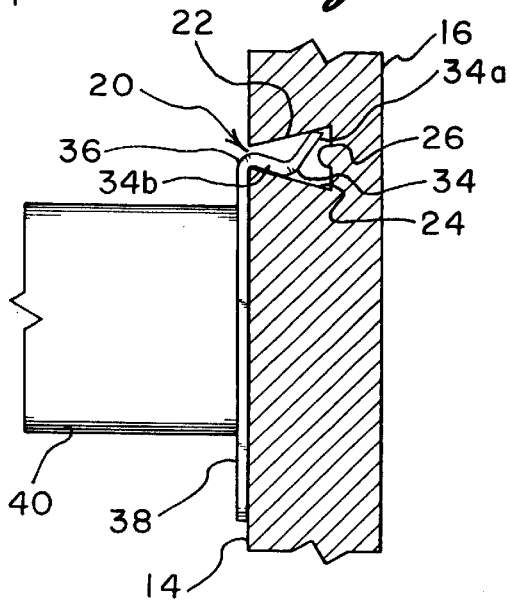
FIG. 5 is a cross-sectional view of the present invention taken along line 5—5 of FIG. 3.
Figure 6:
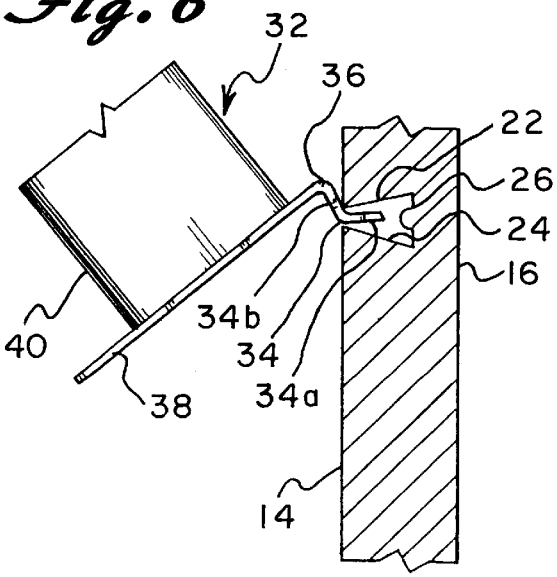
FIG. 6 is a cross-sectional view of the first embodiment of the present invention with an accessory bracket being placed within the slot of the device.
Figure 7:
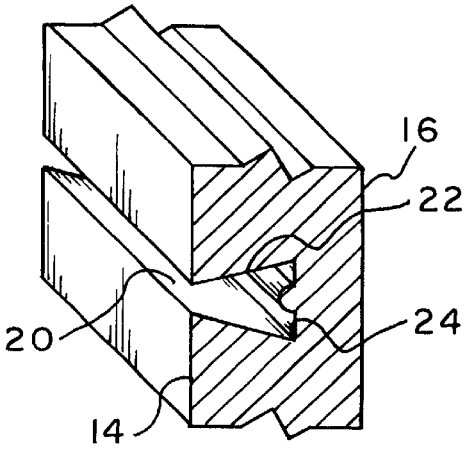
FIG. 7 is a perspective view of the first embodiment of the present invention taken through line 7 of FIG. 4.

Slot 18 has a generally triangular cross-section. That is the slot 18 has an upper surface 22 and a lower surface 24 where the surfaces 22 and 24 converge toward the opening 20 of the slot 18. (See FIG. 5.) Slot 18 also has a rear surface 26. A support member 32, which may be an accessory bracket, having a curved portion 34 consisting of a top member 34*a* and a bottom member 34*b* fits within the slot 18. Extending from the bottom member 34*b* is a generally curved portion 36 with a vertical section 38 extending downwardly therefrom. Extending outwardly from the vertical section 38 is a bar 40. Support member 32 is maintained within the slot 18 via an interference fit. That is, the top member 34*a* fits into the slot 18 so that it bears against the upper surface 22 and the bracket 32 is cammed downwardly, thereby forcing the bottom member 34*b* of the accessory bracket 32 to engage the lower surface 24 of the slot 18. The vertical section 38 rests against the front side 14 of the base member 12. (See FIG. 5.) In its operating position, as seen in FIG. 5, the bar 40 extends outwardly. Hangers or other support devices may be then hung from the bar 40 from which various articles may be displayed.

The design of the slot of the first embodiment of the present invention increases the strength of the slot significantly because two load bearing surfaces are provided as opposed to only one such surface as in the prior art devices. Furthermore, the forces are more in the vertical direction rather than horizontal. That is, as weight is brought to bear on bar 40, top member 34*a* is forced or exerts pressure against upper surface 22 and bottom member 34*b* is thereby forced or exerts pressure against lower surface 24. As a result, the support member 32 is held securely within the slot 18. Furthermore, because the surfaces 22 and 24 converge toward opening 20, as opposed to a T-shaped slot as seen in the prior art, there is no risk of the base member 12 splitting. Also because of the design of the slot, the bracket is held or maintained within the slot more steadily than prior art devices. That is, the bracket does not rotate once it is held within the slot.

Figure 9:
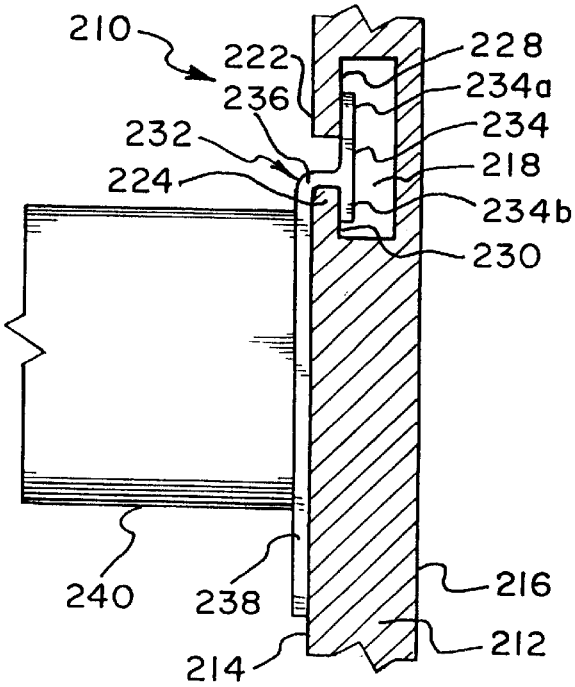
FIG. 9 is a partial cross-sectional view of the second embodiment of the present invention.
Figure 8:
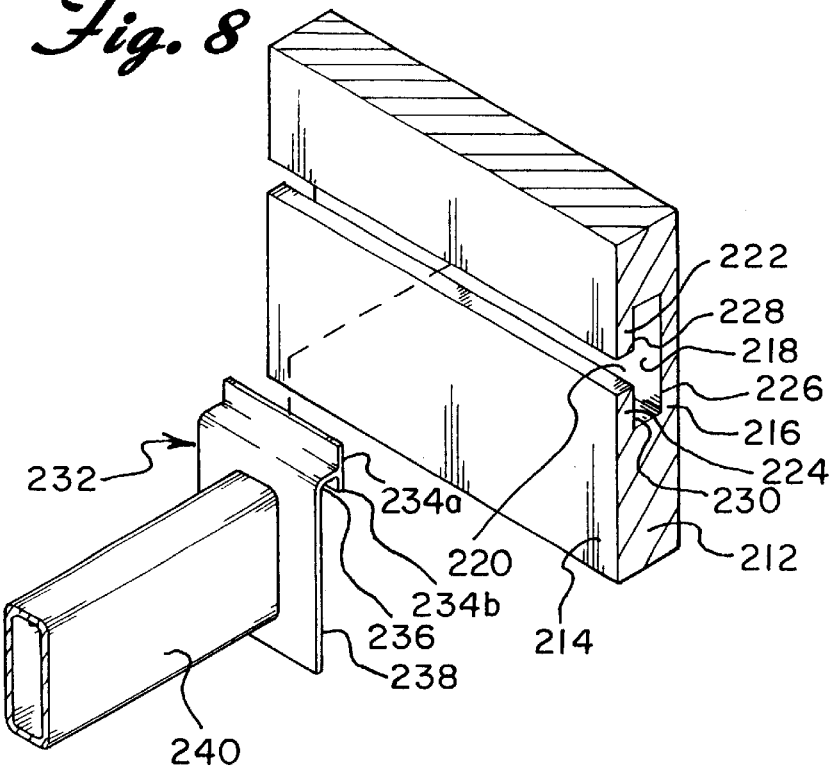
FIG. 8 is a perspective exploded view of a second embodiment of the wall panel system of the present invention.

A second embodiment of the present invention is seen in FIGS. 8 and 9. As in the first embodiment, the wall panel system or 210 includes a base member 212 with a front side 214, a rear side 216, and at least one horizontal slot 218 extending along the front side 214. (See FIG. 8.) While only one slot 218 has been shown and will be discussed, it should be realized that any number of slots may be located within the panel, depending upon the size of the panel and the needs of the user.

Slot 218 has an opening 220 formed by an upper wall 222 facing rearwardly and a lower wall 224 facing rearwardly. The slot 218 also has a rear surface 226 parallel to the rear side 216 of the base member 212, an upper front surface 228, and a lower front surface 230. A support member 232 having a vertical member 234 with a top portion or member 234*a*, a bottom portion or member 234*b* and a curved portion 236 extending from the vertical portion 234 near the bottom portion 234*b* fits within the slot 218 via an interference fit. That is, top portion 234*a* rests against upper front surface 228 and bottom portion 234*b* rests against lower front surface 230. The curved portion 236 rest against lower wall 224. Extending downwardly from curved portion 236 is vertical section 238 which rests against front surface 214. Extending outwardly from the vertical section 238 is a bar 240. Hangers or other support devices may then be hung from the bar from which various articles may be displayed.

In order to position the support member 232 within the slot 218, the top portion 234*a* of vertical member 234 is inserted through the opening 220 at an angle and moved upwardly so that bottom portion 234*b* clears lower wall 224. As the vertical member 234 is righted within the slot 218, top portion 234*a* is positioned against upper front surface 228, bottom portion 234*b* is positioned against lower front surface 230, curved portion 236 rests against lower wall 224, and vertical section 238 rests against front surface 214. The distance between upper wall 222 and lower wall 224 must be large enough so that the entire vertical member 234 may be maneuvered into the slot 218 yet does not allow the bracket 232 to fall out of the slot 218 once the bracket 232 is securely in place. As in the first embodiment, in this embodiment more than load bearing surface is provided. That is, as weight is brought to bear on the bar 240, top portion 234*a* is forced or exerts pressure against upper front surface 228, curved portion 236 is forced or exerts pressure against wall 224, and bottom portion 234*b* is forced or exerts pressure against lower front surface 230. The design of the slot and the design of the bracket increase the strength of the panel system.

The present invention may be embodied in other specific forms without departing from the spirit or essential attributes thereof and accordingly, reference should be made to the appended claims rather than to the foregoing specification as indicating the scope of the invention.

I claim:

1. A wall panel system comprising:

a wall panel including a base member;

at least one horizontal slot within said base member, said slot having a generally triangular cross-section and being formed by an upper surface, a lower surface, and a rear surface, said slot also having an opening; and a support member adapted to fit within said slot so that said support member exerts pressure against both of said upper and lower surfaces of said slot.

2. A wall panel system comprising:

a wall panel including a base member;

at least one horizontal slot within said base member, said slot being formed by an upper surface, a lower surface, and a rear surface, said slot also having an opening; and a support member adapted to fit within said slot so that said support member exerts pressure against both of said upper and lower surfaces of said slot, said support member having a curved portion with a top member and bottom member, said top member exerting pressure against said upper surface of said slot in a generally vertical direction and said bottom member exerting pressure against said lower surface of said slot in a generally vertical direction.

3. A wall panel system comprising:

a wall panel including a base member having a front side;

at least one horizontal slot within said base member, said slot having a generally triangular cross-section and being formed by an upper surface, a lower surface, and a rear surface, said slot also having an opening; and a support member adapted to fit within said slot so that said support member exerts pressure against both of said upper and lower surfaces of said slot, said support member including a vertical section adapted to rest against said front side of said base member at a position below said slot.

4. A wall panel system comprising:

a wall panel including a base member having a front side;

at least one horizontal slot within said base member, said slot being formed by an upper surface, a lower surface, and a rear surface, said slot also having an opening; and a support member adapted to fit within said slot so that said support member exerts pressure against both of said upper and lower surfaces of said slot, said support member including a vertical section adapted to rest against said front side of said base member at a position below said slot, said support member having a curved portion with a top member and bottom member, said top member exerting pressure against said upper surface of said slot in a generally vertical direction and said bottom member exerting pressure against said lower surface of said slot in a generally vertical direction.

* * * * *